US006415464B1

(12) United States Patent
Hsieh

(10) Patent No.: US 6,415,464 B1
(45) Date of Patent: Jul. 9, 2002

(54) HAMMOCK HAVING RETRACTABLE DOWELS

(76) Inventor: Shun-Chang Hsieh, 500-2, Da Chang Rd., Koushing, Nantou Hsien (TW)

( * ) Notice: Subject to any disclaimer, the term of this patent is extended or adjusted under 35 U.S.C. 154(b) by 0 days.

(21) Appl. No.: 09/898,126

(22) Filed: Jul. 5, 2001

(51) Int. Cl.[7] ..... A45F 3/24
(52) U.S. Cl. ..... 5/120; 5/127
(58) Field of Search ..... 5/120, 122, 123, 5/127

(56) References Cited

U.S. PATENT DOCUMENTS 403,315 A * 5/1889 York ..... 5/120 X
2,745,115 A * 5/1956 Reiss ..... 5/122
3,344,443 A * 10/1967 Bonnell ..... 5/120
4,662,132 A * 5/1987 Tennant ..... 5/127 X
4,951,332 A * 8/1990 Barmettler ..... 5/120
5,003,652 A * 4/1991 Bayless ..... 5/122 X
5,297,302 A * 3/1994 Anderson ..... 5/127
5,636,392 A * 6/1997 Choi ..... 5/127

FOREIGN PATENT DOCUMENTS

GB 462955 * 3/1937 ..... 5/123

* cited by examiner

*Primary Examiner*—Robert G. Santos
(74) *Attorney, Agent, or Firm*—Charles E. Baxley

(57) ABSTRACT

A hammock includes a bed portion connected between two dowel assemblies. Each dowel assembly has a main tube with two open ends and two end sections retractably received in the two open ends of the main tube. Each of the end section has an engaging slot for being connected with two clews.

4 Claims, 6 Drawing Sheets

HAMMOCK HAVING RETRACTABLE DOWELS

FIELD OF THE INVENTION

The present invention relates to a hammock having two dowels and each dowel has two end sections retractably received in a main tube so that the hammock can be stored in a compact size.

BACKGROUND OF THE INVENTION

A conventional hammock is shown in FIG. 1 and generally includes a bed portion 11 connected between two dowels 10, and two clews 12 are respectively connected to the two dowels 10. The conventional hammock can be easily scrolled by wrapping the bed portion 11 on the dowels 10 as shown in FIG. 2. However, because the length of the dowels 10 is required to be longer than the width of a user's shoulders so that although the hammock can be folded to be a tubular size, it is still too long for the user to put the folded hammock in his/her back bag.

SUMMARY OF THE INVENTION

In accordance with one aspect of the present invention, there is provided a hammock which comprises a bed portion connected between two dowel assemblies and two clews are connected to the two dowel assemblies. Each of the dowel assemblies has a main tube with two open ends and two end sections are respectively and retractably received in the two open ends of the main tube. Each of the end section has an engaging slot so as to be connected to the two clews.

The primary object of the present invention is to provide a hammock that has retractable dowels so that the hammock can be folded to be a small pack for convenience of storage and carriage.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
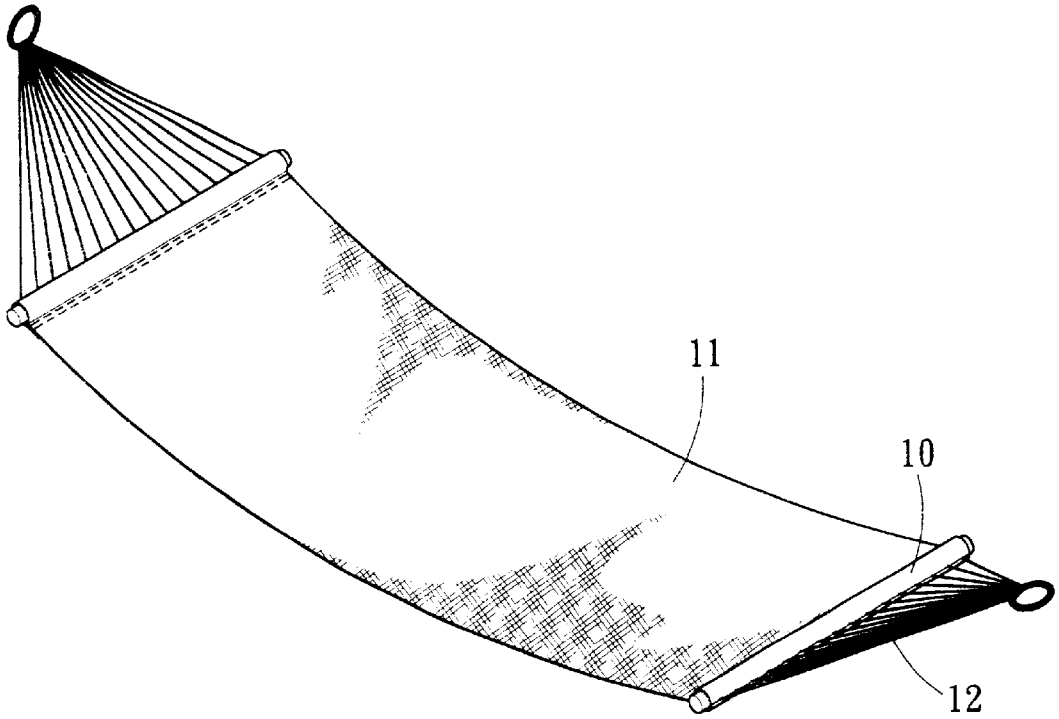
F I G. 1 PRIOR ART
FIG. 1 is a perspective view to show a conventional hammock.
Figure 2:
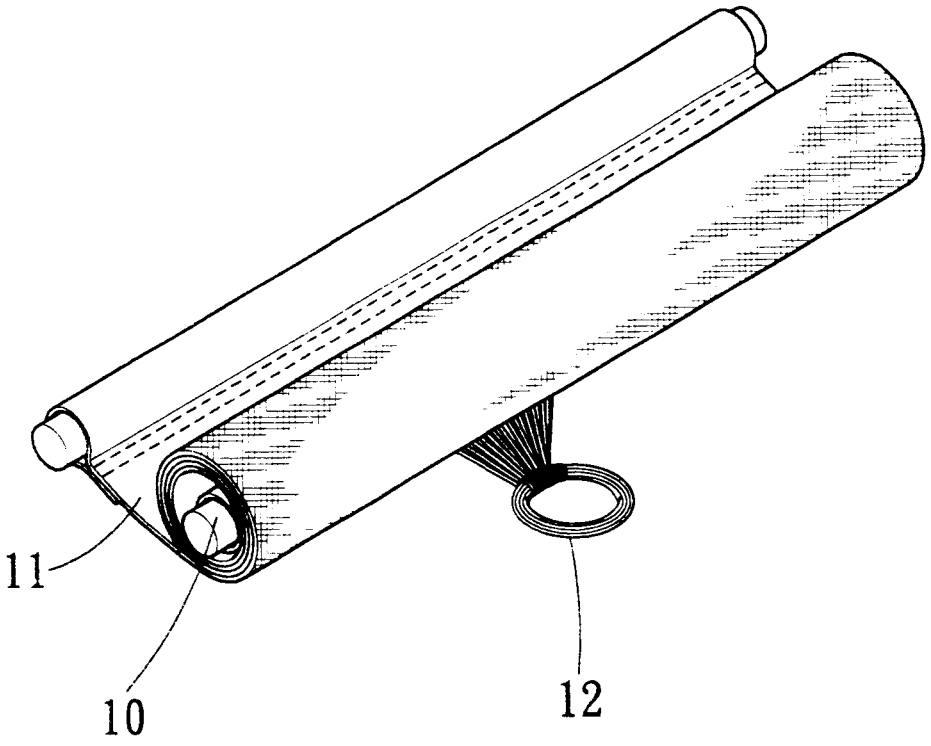
F I G. 2 PRIOR ART
FIG. 2 shows that the conventional hammock is folded.
Figure 3:
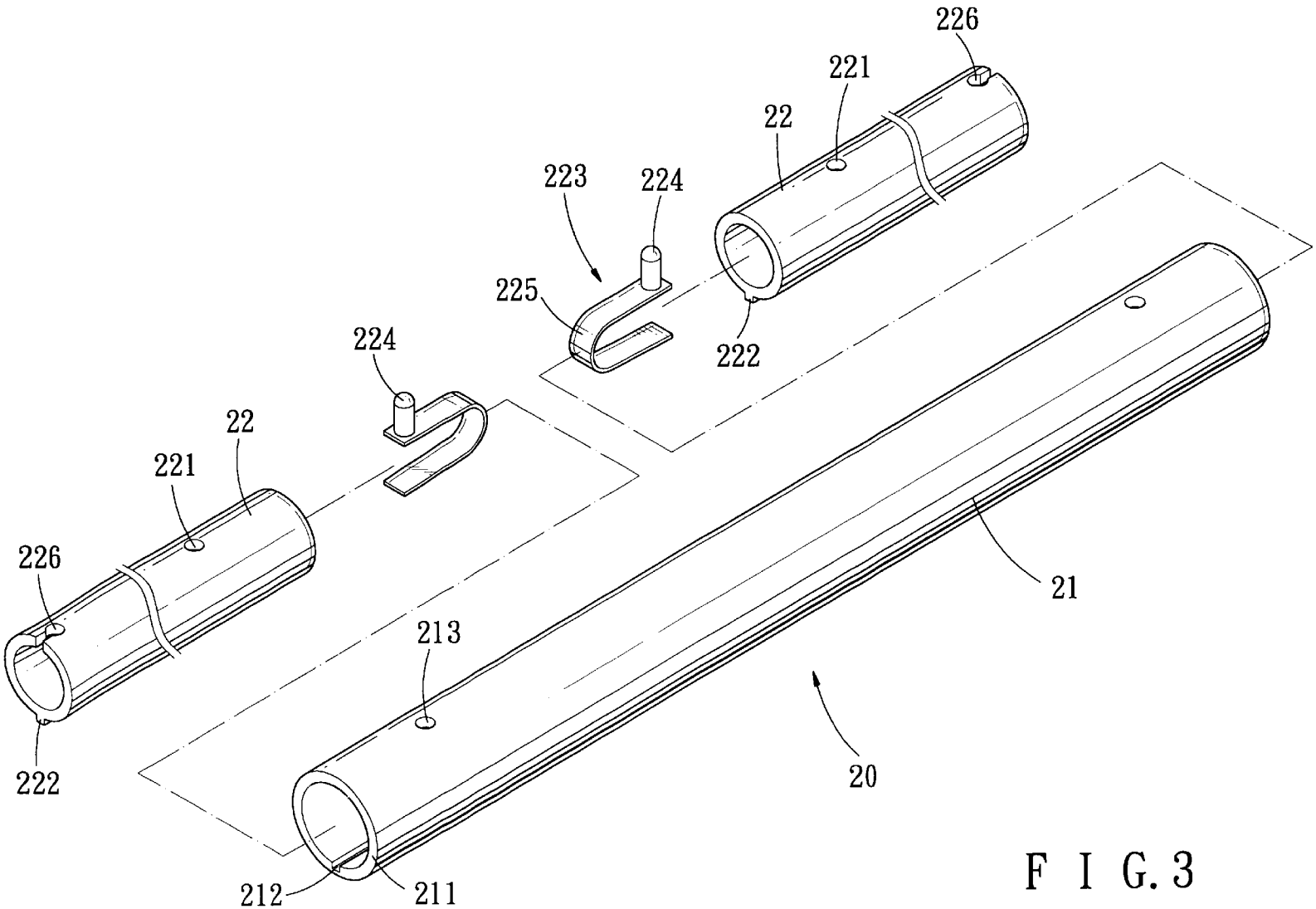
FIG. 3 is an exploded view to show a dowel assembly of the hammock of the present invention.
Figure 4:
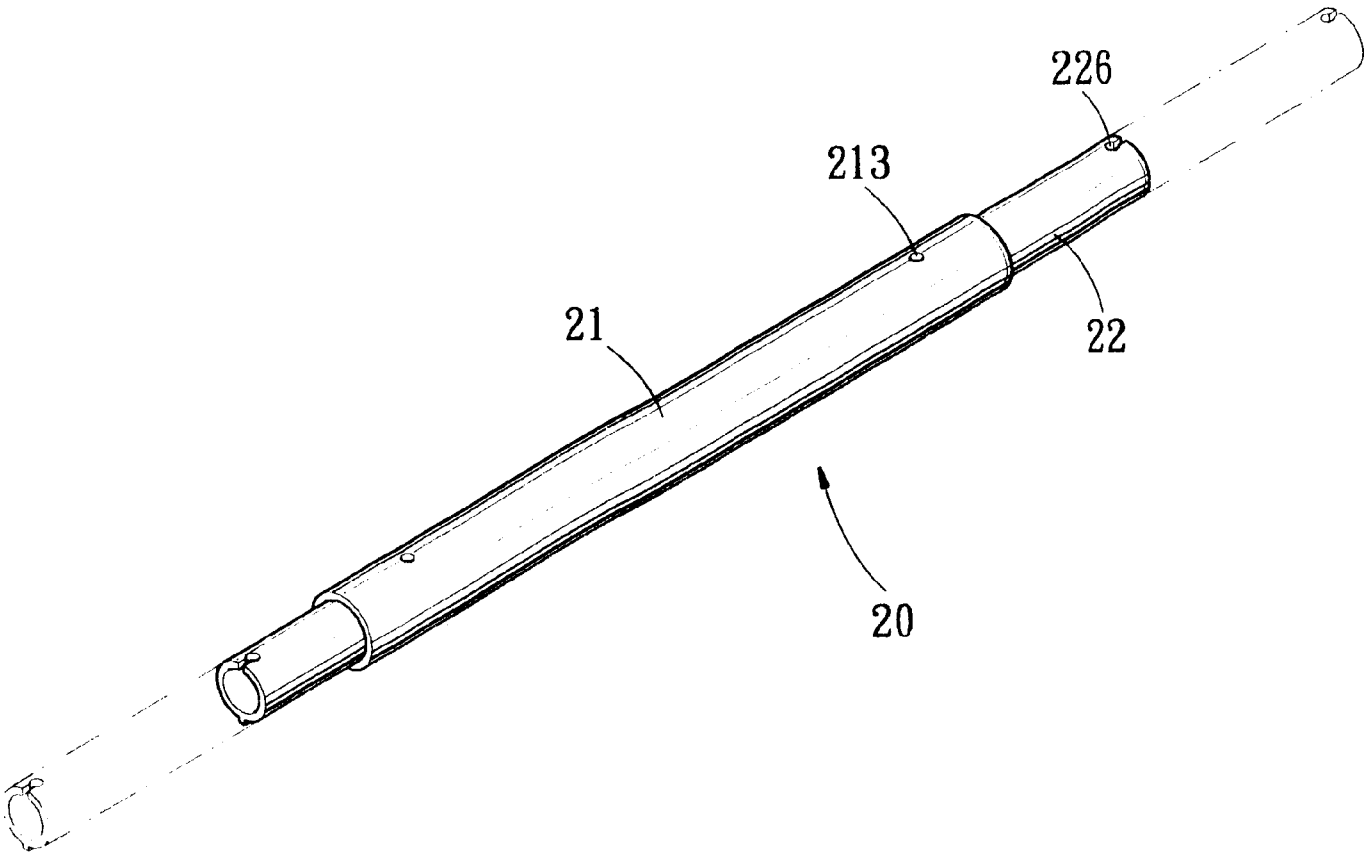
FIG. 4 is a perspective view to show the dowel assembly of the hammock of the present invention is retractable.
Figure 5:
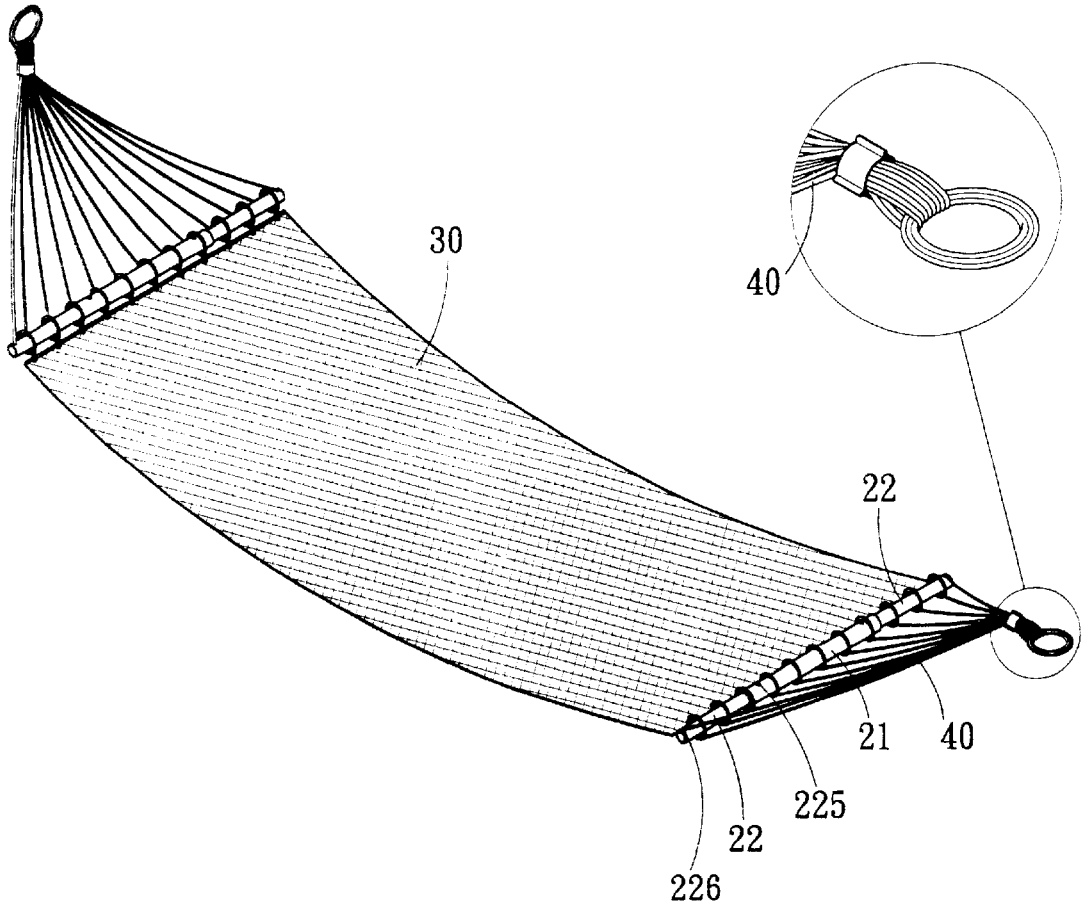
FIG. 5 is a perspective view to show the dowel assembly of the hammock of the present invention.

Referring to FIGS. 3 to 5, the hammock of the present invention comprises a bed portion 30 connected between two dowel assemblies 20. Each dowel assembly 20 has a main tube 21 with two open ends and two end sections 22 are respectively and retractably received in the two open ends of the main tube 21. Each of the end sections 22 has a first aperture 221 defined in a wall thereof and a U-shaped positioning member 223 is received in each of the end sections 22. Each positioning member 223 has a biasing portion 225 and a positioning protrusion 224 extends from the biasing portion 225. The main tube 21 having two second apertures 213 defined therethrough at two ends thereof so that the positioning members 223 may extend through the first apertures 221 and the second apertures 213 to position the end sections 22.

Each of the end section 22 has an engaging slot 226 defined in an end thereof and each of the engaging slots 226 has a passage and an enlarged hole which communicates with the passage. The passage communicates with the end of each of the engaging slots 226. Two clews 40 are respectively mounted to the two dowel assemblies 20 and engaged with the two respectively engaging slots 226 via the passages and engaged with the enlarged holes.

Two grooves 212 are defined in an inner periphery of two ends of the main tube 21 and each end section 22 has a ridge 222 extending from an outer periphery thereof. The ridges 222 are slidably engaged with the grooves 212 so as to prevent from rotation of the end sections 22 in the main tube 21.

Figure 6:
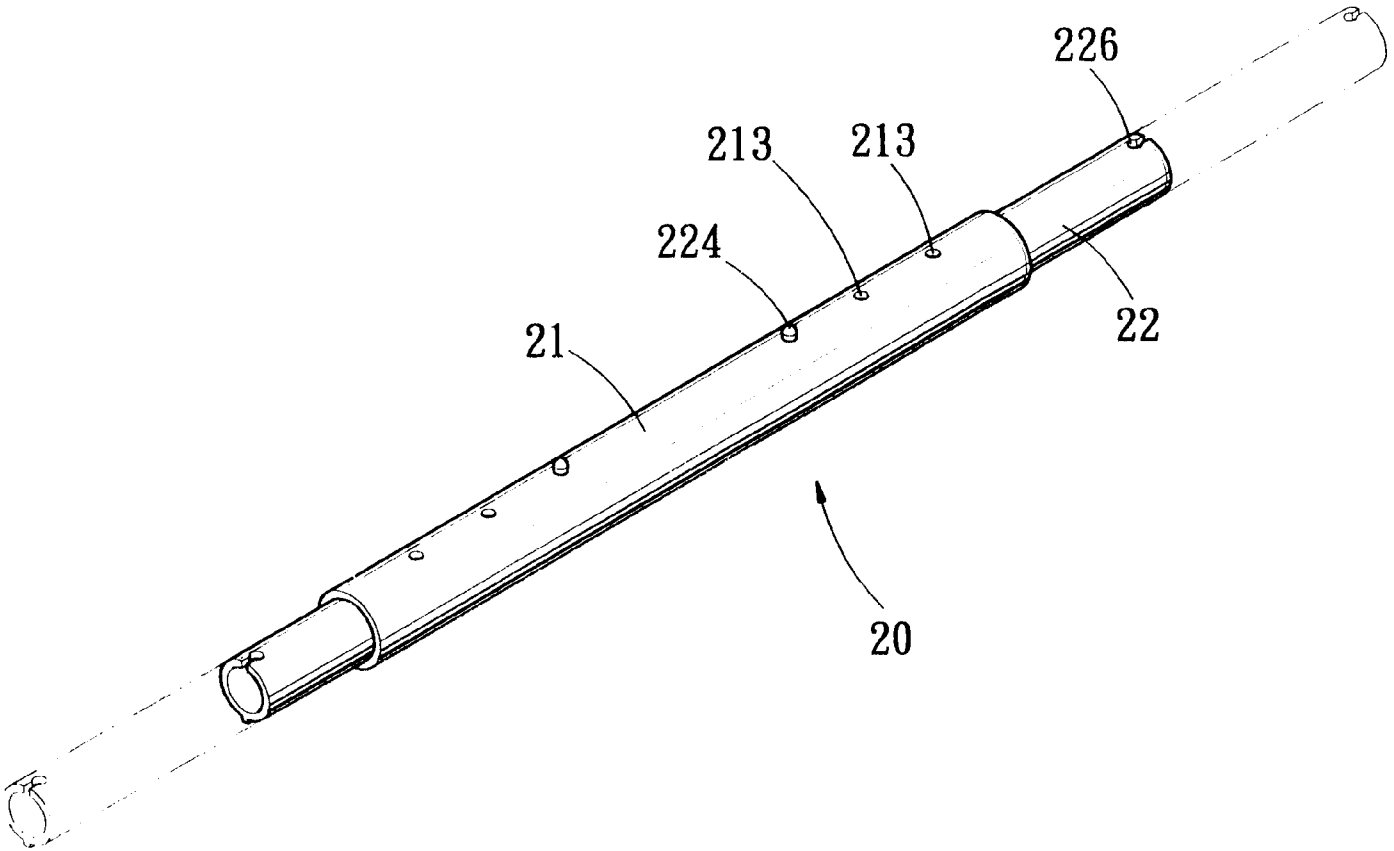
FIG. 6 shows that there are a plurality of apertures in the main tube of the dowel assembly of the hammock of the present invention.

FIG. 6 shows that the number of the second apertures 213 can be plural so that the end sections 22 can be positioned at different positions.

By the retractable dowel assemblies 20, the hammock can be stored in a small pack which is easily received in a personal back bag.

While we have shown and described the embodiment in accordance with the present invention, it should be clear to those skilled in the art that further embodiments may be made without departing from the scope of the present invention.

What is claimed is:

1. A hammock comprising:

a bed portion;

two dowel assemblies between which said bed portion is connected, each dowel assembly having a main tube with two open ends and two end sections respectively and retractably received in said two open ends of said main tube, each of said end section having an engaging slot defined in an end thereof, and two clews respectively mounted to said two dowel assemblies and engaged with said two respectively engaging slots.

2. The hammock as claimed in claim 1, wherein each of said end sections has a first aperture defined in a wall thereof and a positioning member received in each of said end sections, each positioning member having a biasing portion and a positioning protrusion extending from said biasing portion, said main tube having a plurality of second apertures defined therethrough, said positioning members extending through said first apertures and said second apertures.

3. The hammock as claimed in claim 1, wherein each of said engaging slots has a passage and an enlarge hole which communicates with said passage, said passage communicating with said end of each of said engaging slots.

4. The hammock as claimed in claim 1 further comprising two grooves defined in an inner periphery of two ends of said main tube and each end section having a ridge extending from an outer periphery thereof, said ridges slidably engaged with said grooves.

* * * * *